US006815881B2

(12) United States Patent
Chen et al.

(10) Patent No.: US 6,815,881 B2
(45) Date of Patent: Nov. 9, 2004

(54) COLOR CRT ELECTRON GUN WITH PROGRESSIVELY REDUCED ELECTRON BEAM PASSING APERTURE SIZE

(75) Inventors: Hsing-Yao Chen, Fox River Grove, IL (US); Hsiang-Lin Chang, Taoyuan (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 195 days.

(21) Appl. No.: 10/073,560

(22) Filed: Feb. 11, 2002

(65) Prior Publication Data

US 2003/0151346 A1 Aug. 14, 2003

(51) Int. Cl.[7] ..... H01J 29/51; H01J 29/62

(52) U.S. Cl. ..... 313/414; 313/409; 313/447

(58) Field of Search ..... 313/409, 412, 313/413, 414, 441, 446, 447, 448, 449; 315/15, 382, 368.11, 368.15

(56) References Cited

U.S. PATENT DOCUMENTS

| | | | | | |
|---|---|---|---|---|---|
| 3,524,094 | A | | 8/1970 | Hasker et al. | 313/76 |
| 3,801,817 | A | | 4/1974 | Goodman | 250/365 |
| 4,177,462 | A | | 12/1979 | Chung | 340/703 |
| 4,193,071 | A | | 3/1980 | Hasegawa et al. | 340/723 |
| 4,225,880 | A | | 9/1980 | Goodman | 358/66 |
| 4,234,814 | A | | 11/1980 | Chen et al. | 313/412 |
| 4,247,869 | A | | 1/1981 | Culter et al. | 358/67 |
| 4,408,223 | A | | 10/1983 | Midland | 358/67 |
| 4,439,735 | A | | 3/1984 | Alvite et al. | 324/404 |
| 4,507,585 | A | | 3/1985 | Inoue et al. | 313/471 |
| 4,635,106 | A | | 1/1987 | Shinkai | 358/68 |
| 4,701,677 | A | | 10/1987 | Ashizaki et al. | 315/382 |
| 5,055,749 | A | * | 10/1991 | Chen et al. | 315/368.11 |
| 5,113,112 | A | | 5/1992 | Shimoma et al. | 313/412 |
| 5,159,240 | A | | 10/1992 | Chen et al. | 315/14 |
| 5,182,492 | A | | 1/1993 | Chen | 315/14 |
| 5,204,585 | A | | 4/1993 | Chen | 315/15 |
| 5,220,239 | A | | 6/1993 | Chen | 313/414 |
| 5,223,764 | A | | 6/1993 | Chen | 313/414 |
| 5,241,240 | A | | 8/1993 | Chen et al. | 313/414 |
| 5,281,896 | A | * | 1/1994 | Bae et al. | 315/15 |
| 5,316,879 | A | | 5/1994 | Berger et al. | 430/5 |
| 5,327,044 | A | | 7/1994 | Chen | 313/433 |
| 5,350,967 | A | | 9/1994 | Chen | 313/413 |
| 5,376,505 | A | | 12/1994 | Berger et al. | 430/296 |
| 5,424,173 | A | | 6/1995 | Wakabayashi et al. | 420/296 |
| 5,483,128 | A | | 1/1996 | Chen | 315/382 |
| 5,532,547 | A | | 7/1996 | Park et al. | 313/414 |
| 5,593,761 | A | | 1/1997 | Itoh et al. | 428/210 |
| 5,689,158 | A | | 11/1997 | Chen | 315/382 |
| 6,013,976 | A | * | 1/2000 | Gorski et al. | 313/412 |
| 6,153,970 | A | | 11/2000 | Chen et al. | 313/412 |
| 6,236,152 | B1 | * | 5/2001 | Kimiya et al. | 313/412 |
| 6,313,575 | B1 | * | 11/2001 | Kimiya et al. | 313/414 |
| 6,339,293 | B1 | * | 1/2002 | Kimiya et al. | 315/15 |
| 6,608,435 | B1 | * | 8/2003 | Kimiya et al. | 313/412 |

* cited by examiner

*Primary Examiner*—Nimeshkumar D. Patel
*Assistant Examiner*—Karabi Guharay
(74) *Attorney, Agent, or Firm*—Emrich & Ditmar

(57) ABSTRACT

An electron gun includes plural aligned charged grids each having an aperture (in a monochrome CRT) or plural apertures (in a color CRT) through which an electron beam (or beams) is directed. The beams emitted by a cathode sequentially transit a beam forming region (BFR), a dynamic focus lens and a main focus lens prior to being incident on the CRT's display screen. The electron beam tends to expand in diameter in the direction of the CRT's display screen. This results in an increase in the focusing effect on the electron beam of the electron gun's grids in proceeding from the BFR toward the display screen where the beam passing apertures in the various grids are of the same size. To increase electron beam focusing sensitivity while reducing the beam's dynamic focus voltage, the beam passing apertures in the gun's dynamic focus lens are provided with progressively reduced size in proceeding toward the electron gun's cathode.

7 Claims, 10 Drawing Sheets

COLOR CRT ELECTRON GUN WITH PROGRESSIVELY REDUCED ELECTRON BEAM PASSING APERTURE SIZE

FIELD OF THE INVENTION

This invention relates generally to self-emitting video display devices such as of the cathode ray tube (CRT) type and is particularly directed to a multi-grid electron gun such as used in a CRT having progressively reduced beam passing apertures in its charged grids in proceeding toward the electron gun's cathode(s).

BACKGROUND OF THE INVENTION

In a conventional electron gun such as used in either a monochrome or color CRT, energetic electrons are emitted from a cathode (or cathodes) and are directed to the gun's beam forming region (BFR). The BFR includes the G1 control grid, the G2 screen grid and a portion of a G3 grid in facing relation with the G2 screen grid. The energetic electrons are directed through aligned apertures in these three grids and are thereby formed into a well-defined beam, or beams, having a very small, circular cross section. After transiting the electron gun's BFR, the beams are directed through a focus lens, typically divided into a pre-focus lens and a main focus lens, for focusing the electron beams on a phosphor-bearing display screen of the CRT. The focus lens focuses each of the beams to a small spot on the CRT's display screen, with the beams simultaneously deflected in a raster-like manner at very high speeds to form a video image on the display screen. In the case of a typical color CRT, three electron beams are simultaneously formed, focused, and converged to a single spot on the display screen. The three electron beams are then displaced in unison in a raster-like manner over the display screen in forming a color video image.

The beam passing apertures in the BFR are typically small in size, with the apertures in the electron gun's G1 control grid and G2 screen grid typically on the order of 0.3 mm to 0.8 mm in diameter. The bottom portion of the G3 grid in facing relation with the G2 screen grid includes apertures which are somewhat larger in that they are typically on the order of 1 mm to 2 mm. The top portion of the G3 grid as well as the G4 and subsequent grids, including auxiliary dynamic modulation grids, have larger beam passing apertures which are typically on the order of 4.5 mm to 7.5 mm in diameter for color electron guns. Aperture size increases in proceeding toward the CRT's display screen in the main focusing lens region in color electron guns due to the "common lens" design utilized in this portion of the electron gun. Even larger electron beam passing apertures are typically used in monochrome electron guns.

Up The electrons exiting the BFR are formed into a beam bundle for subsequent focusing by the pre-focus lens and main focus lens to a small spot on the CRT's display screen. After exiting the electron gun's BFR, the diameter of the beam increases continuously as the electrons travel in the direction of the display screen along the gun's Z-axis. The electron beam expands in the R-direction which is transverse to the Z-axis. This electron beam expansion is due to the velocity of electrons along the R-direction, as well as to the space-charge effect in the beam caused by the mutual repulsion between the electrons in the beam.

The beam passing apertures in the various grids in an electron gun are generally of the same diameter. The primary reason for equal sized apertures in each of the gun's charged grids relates to the use of a mandrel in electron gun assembly. A mandrel is inserted through each aligned array of beam passing apertures in the various grids to maintain the grids in common alignment during the beading process in electron gun assembly. The common sized beam passing apertures and the use of a generally cylindrical mandrel for grid alignment greatly simplifies and facilitates electron gun assembly.

As the electron beam expands in diameter after it exits the electron gun's BFR, the focusing effect of each grid in the lens portion of the electron gun, where all of the grids have beam passing apertures of essentially the same size, becomes progressively stronger due to the progressively increasing diameter of the electron beam. Thus, the closer the charged grid is to the CRT's display screen, the stronger is its focusing effect on the electron beam. Conversely, in the area of the BFR as well as in the lower portion of the gun's pre-focus lens region, the charged grids have a reduced focusing effect on the electron beam due to the beam's small diameter in this region. Because of the reduced focusing effect of the grids in this region, a larger dynamic focus voltage is required to correct for astigmatism of the deflected beam's spot size caused by the CRT's inline deflection yoke as well as to correct for out-of-focus effects which arise from the electron beam's increased landing or throw distance. Reducing the dynamic focus voltage required to correct for astigmatism of the deflected beam places increased demands on electron gun design requirements.

The present invention addresses the aforementioned limitations of the prior art by providing progressively reduced electron beam passing aperture size in an electron gun for use in a CRT which increases electron beam focusing sensitivity without increasing beam spot aberration on the CRT's display screen or the out-of-focus effects on the video image. By providing the BFR and pre-focus lens of the electron gun with progressively reduced electron beam passing aperture size in proceeding toward the gun's cathode, increased electron beam focusing sensitivity is provided without increasing dynamic focus voltage or electron beam spot aberration on the display screen.

OBJECTS AND SUMMARY OF THE INVENTION

Accordingly, it is an object of the present invention to provide in an electron gun of a CRT increased electron beam focusing sensitivity for improved video image quality.

It is another object of the present invention to reduce the dynamic voltage is required in the electron gun of a CRT to correct for electron beam astigmatism and out-of-focus effects.

Yet another object of the present invention is to provide for the assembly of a multi-grid color CRT electron gun with charged grids having reduced diameter electron beam passing apertures using a mandrel.

The present invention contemplates an electron gun for use in a cathode ray tube (CRT) for producing a video image on a display screen, the electron gun comprising a cathode for providing energetic electrons; a beam forming region (BFR) aligned with the cathode and disposed intermediate the cathode and the display screen for receiving and forming the energetic electrons into an elongated, narrow beam, the BFR including plural spaced first charged grids each having one or more first aligned apertures, wherein the electrons are directed through the first aligned apertures and the electron beam increases in cross section in proceeding from the BFR toward the display screen; and an electrostatic lens disposed intermediate the BFR and the display screen and including plural spaced second charged grids each having one or more second aligned apertures through which the electron beam is directed for focusing the electron beam on the display screen, wherein the second aligned apertures decrease in size in proceeding in a direction from the display screen toward the BFR for increasing focusing sensitivity of the electrostatic lens on the electron beam.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
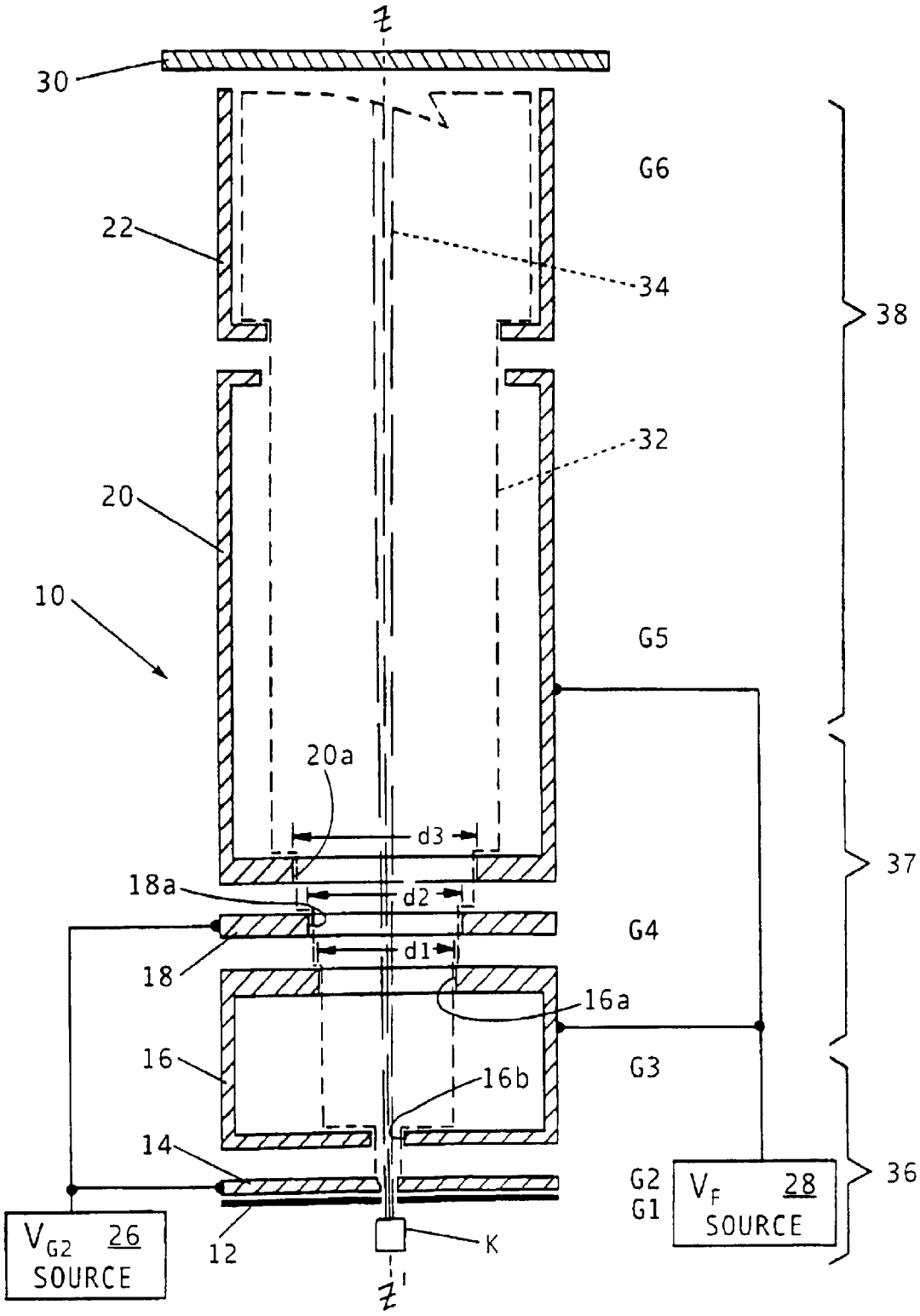
FIG. 1 is a simplified longitudinal sectional view of a quadrupole-type electron gun for use in a CRT having progressively reduced electron beam passing aperture size in accordance with the principles of the present invention.

Referring to FIG. 1, there is shown a simplified longitudinal sectional view of a quadrupole-type (QPF) electron gun 10, but without a dynamic quadrupole, having progressively reduced electron beam passing aperture size in accordance with one embodiment of the present invention. The present invention is applicable to electron guns used in both monochrome and color CRTs. The electron gun 10 shown in FIG. 1 is thus applicable to both monochrome and color CRTs, it being understood that the electron beam 34 shown in dotted line form in the figure is only one of three beams in a color CRT. In this latter case, the electron gun 10 generates and directs two additional inline electron beams (which are not shown in the figure for simplicity), with one electron beam in spaced relation from the center electron beam 34 into the plane of the sheet and the other electron beam disposed above the plane shown in FIG. 1, or toward the reader. Thus, for simplicity, only the center electron beam 34 as well as the aligned beam passing apertures in the various grids through which the electron beam is directed are shown in FIG. 1, where the electron gun 10 is a multi-beam electron gun such as used in a color CRT.

Electron gun 10 includes a cathode K for generating energetic electrons and directing these electrons through aligned apertures in a G1 control grid 12 and a G2 screen grid 14. In the case of a multi-beam electron gun, electron gun 10 further includes two additional cathodes which are not shown in the figure for simplicity, with one of these cathodes disposed below the plane of FIG. 1 and the other cathode disposed above the plane of the figure. While the following discussion is limited to the center electron beam 34 and the grid apertures through which this beam is directed, this discussion is equally applicable to the two outer electron beams in electron gun 10 which as indicated above are not shown in the figure for simplicity.

The electron gun's beam forming region (BFR) 36 is comprised of the G1 control grid 12, the G2 screen grid 14, and a lower side of a G3 grid 16. QPF electron gun 10 further includes a dynamic focus lens 37 comprised of the upper side of the G3 grid 16, a G4 grid 18, and the lower side of a G5 grid 20. The three electron beams, including the center electron beam 34 (shown in the figure in dotted line form), are focused on the display screen 30 by means of a main focus lens 38 comprised of the upper side of the G5 grid 20 and a G6 grid 22. The G1 grid 12 is typically maintained at zero voltage, while the G2 screen grid 14 and the G4 grid are typically coupled to a common voltage $V_{G2}$ source 26 and the G3 and G5 grids 16, 20 are coupled to a common focus voltage $V_F$ source 28. The $V_{G2}$ source 26 maintains the G2 screen and G4 grids 14, 18 at a voltage in the range of 400–750 V. The G6 grid 22 is typically coupled to an accelerating, or anode, voltage source which is not shown in the figure for simplicity. Each of the three electron beams is directed through plural aligned apertures in the various grids of electron gun 10 as the electrons proceed from each respective cathode K toward the CRT's display screen 30.

As shown in FIG. 1, electron beam 34 is directed through the BFR 36 of electron gun 10 in the form of a narrow bundle along the longitudinal axis Z–Z' of the electron gun. After passing through the electron gun's BFR 36, the beam, or beams, expand radially because of the beam's space-charge effect and the radial thermal velocity component of the electrons which is perpendicular to the gun's longitudinal axis Z–Z'. The effect of these phenomena is to increase the cross section of the electron beam 34 as it proceeds from the BFR 36 and sequentially through the gun's dynamic focus lens 37 and its main focus lens 38 prior to being incident upon display screen 30.

In accordance with the present invention, in order to increase the focus sensitivity of the electron gun 10 on the electron beam 34, the beam passing apertures in the gun's dynamic focus lens 37 are provided with reduced diameter in proceeding toward cathode K. Thus, the aperture 16*a* in the high end of the G3 grid 16 is provided with a diameter d1, while the beam passing aperture 18*a* in the G4 grid is provided with a diameter d2. Finally, the beam passing aperture 20*a* in the low end of the G5 grid 20 is provided with a diameter d3, where d3≧d2≧d1. Thus, in the dynamic focus lens 37 of electron gun 10 the respective beam passing apertures in the low end of the G5 grid 20, in the G4 grid 18, and in the high end of the G3 grid 16 are of decreasing diameter to accommodate the reduced diameter of the electron beam 34 in proceeding in the direction of cathode K. This increases the focus sensitivity of the electron gun's dynamic focus lens 37 on electron beam 34 and corrects for beam astigmatism with minimum spherical aberration of the beam.

Also shown in FIG. 1 in dotted line form is a mandrel 32 inserted through aligned apertures in the electron gun's G1, G2, G3, G4, G5 and G6 grids. In proceeding toward the electron gun's cathode K, mandrel 32 is tapered in a step-wise manner so as to accommodate the reduced diameters of apertures 20*a*, 18*a* and 16*a*, 16*b* respectively disposed in the G5, G4 and G3 grids 20, 18 and 16 as well as the apertures in the G1 and G2 grids. The distal end of mandrel 32 is tapered in a step-wise manner in proceeding toward the electron gun's cathode K for insertion in a tight-fitting manner in apertures in the G5, G4, G3, G2 and G1 grids for precisely aligning these grids during assembly of electron gun 10. Once the electron gun 10 is assembled, mandrel 32 is removed from the aligned grid assembly for completion of assembly of the electron gun. In the case of a multi-beam color CRT incorporating three inline electron beams, a mandrel 32 as shown in FIG. 1 would be inserted through each of the three groups of aligned beam passing apertures for precisely aligning the electron gun's grids during assembly. Each of three such mandrels preferably would be incorporated in an alignment jig used in the assembly of the multi-beam electron gun.

Figure 2:
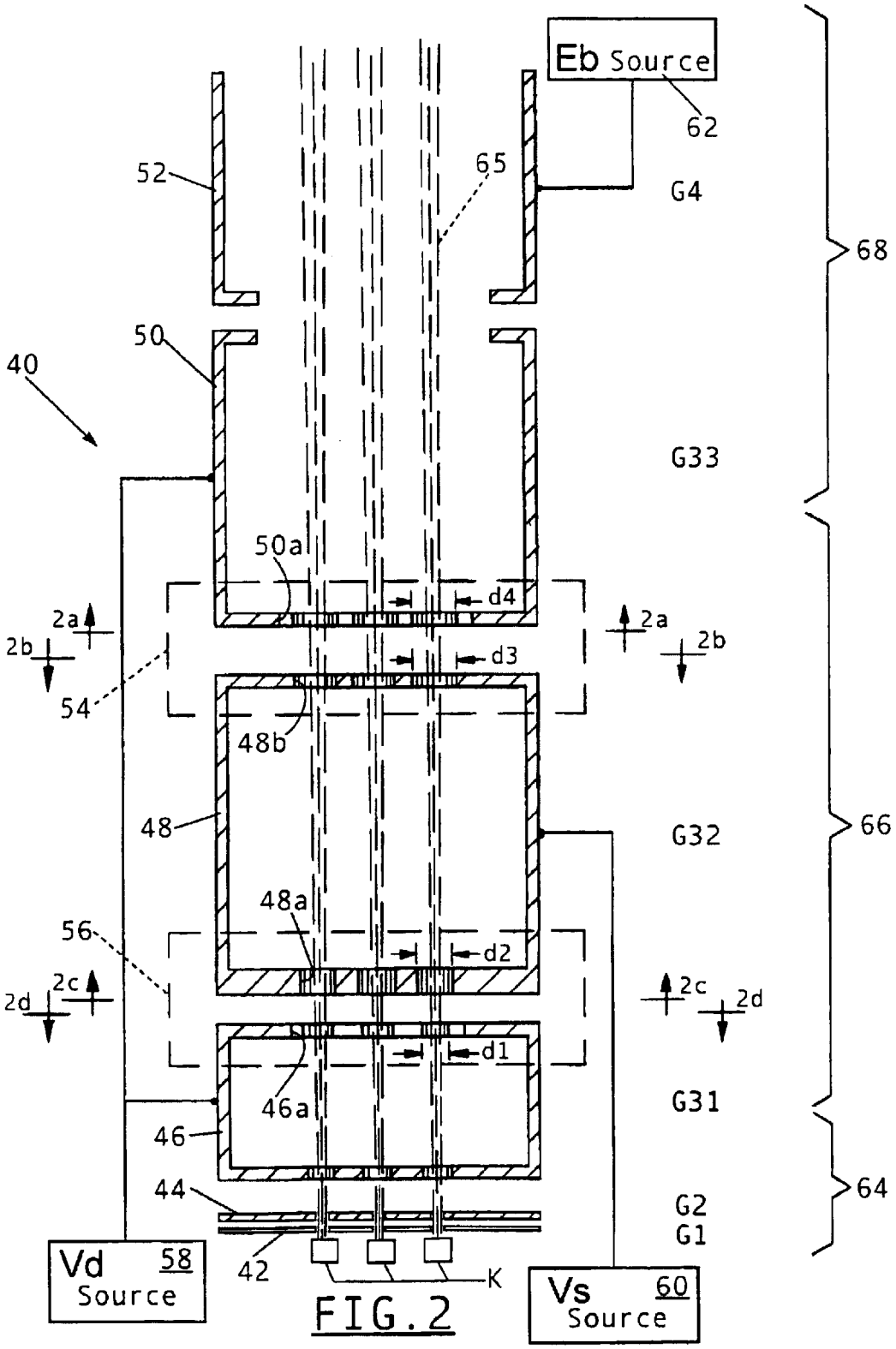
FIG. 2 is a simplified longitudinal sectional view of one embodiment of a bi-potential electron gun with progressively reduced electron beam passing aperture size in accordance with the present invention.

Referring to FIG. 2, there is shown a simplified longitudinal sectional view of a bi-potential electron gun 40 incorporating a progressively reduced electron beam passing aperture size in accordance with the principles of the present invention. Bi-potential electron gun 40 includes a cathode K which generates and directs energetic electrons through aligned apertures in a G1 control grid 42 and a G2 screen grid 44. The electron beam 65 (shown in dotted line form) is then sequentially directed through aligned apertures in a G31 grid 46, a G32 grid 48, a G33 grid 50, and a G4 grid 52. The electron beam 65 is incident upon the CRT's display screen which is not shown in FIG. 2 for simplicity. In addition, while FIG. 2 shows only a single set of aligned apertures in the various charged grids such as in a monochrome CRT, the arrangement shown in FIG. 2 is also applicable to a color CRT including three inline apertures in each grid, with each aperture adapted for passing a respective electron beam.

The G1 control grid 42, G2 screen grid 44 and the bottom portion of the G31 grid 46, i.e., in facing relation to the G2 screen grid, form the electron gun's beam forming region (BFR) 64. The upper portion of the G31 grid 46, the G32 grid 48 and the lower portion of the G33 grid 50 form the electron gun's dynamic focus lens 66. The upper portion of the G33 grid 50 in combination with the G4 grid 52 form the electron gun's main focus lens 68. A focus voltage $E_b$ source 62 is coupled to the G4 grid 52 for focusing the electron beams.

A dynamic voltage $V_d$ source 58 is coupled to the G31 grid 46 and the G33 grid 50. A fixed voltage $V_s$ source 60 is connected to the G32 grid 48. The $V_d$ source 58 provides a time variable voltage to the G31 and G33 grids 46, 50. A fixed voltage is provided to the G32 grid 48 by the $V_s$ source 60. The combination of the fixed voltage provided to the G32 grid 48 and time variable voltage provided to the G31 and G33 grids 46, 50 produces first and second dynamic quadrupoles 54 and 56 (shown in dotted line form in FIG. 2.) The first and second dynamic quadrupoles 54, 56 form a time variable quadrupole lens to compensate for the deflection yoke's astigmatism effect. The first dynamic quadrupole 54 is formed between the top portion of the G32 grid 48 and the bottom portion of the G33 grid 50. The second dynamic quadrupole 56 is formed between the top portion of the G31 grid 46 and the bottom portion of the G32 grid 48.

In accordance with the present invention, the first and second dynamic quadrupoles 54 and 56 are disposed in the electron gun's dynamic focus lens 66. In proceeding toward the electron gun's cathode K, it can be seen that the beam passing aperture 50*a* in the bottom portion of the G33 grid 50 is greater in diameter then the adjacent beam passing aperture 48*b* in the top portion of the G32 grid 48. Similarly, in the second dynamic quadrupole 56 beam passing aperture 48*a* in the bottom portion of the G32 grid 48 is larger in diameter then the beam passing aperture 46*a* in the top portion of the G31 grid 46. Thus, in the electron gun's prefocus lens 66, d4>d3>d2>d1. The decreasing diameters of the beam passing apertures in proceeding in the electron gun's dynamic focus lens 66 toward it's cathode K provides increased focusing sensitivity for electron beam 65 as it expands in diameter in proceeding from the electron gun's cathode K towards the display screen.

Figure 2A:
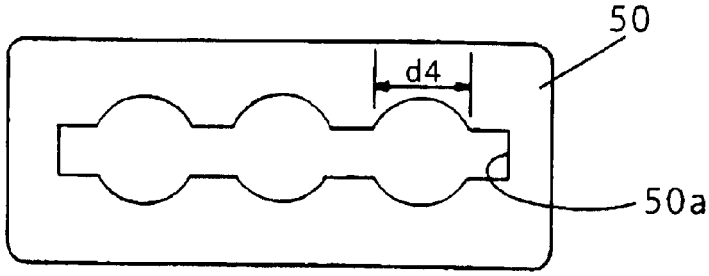
FIGS. 2*a*–2*d* are sectional views of the bi-potential electron gun of FIG. 2 taken respectively along sight lines 2*a*—2*a*, 2*b*—2*b*, 2*c*—2*c* and 2*d*—2*d* therein.
Figure 2B:
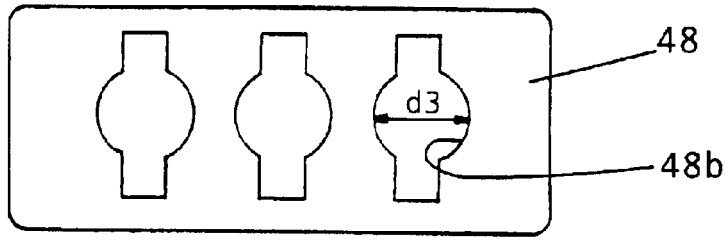
Figure 2C:
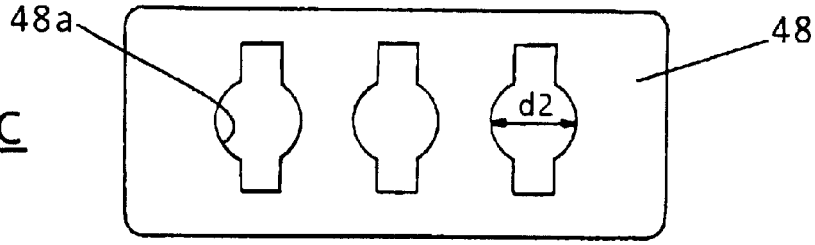
Figure 2D:
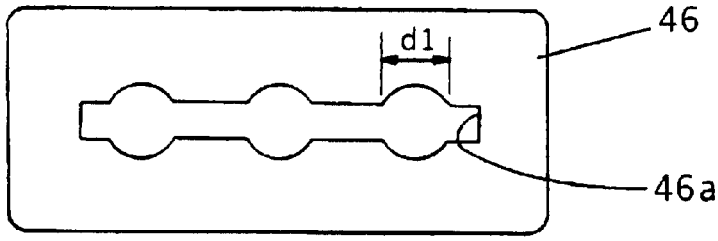

Referring to FIGS. 2*a*–2*d*, there are shown sectional views of the bi-potential electron gun 40 shown in FIG. 2 taken respectively along sight lines 2*a*—2*a*, 2*b*—2*b*, 2*c*—2*c* and 2*d*—2*d*. As shown in FIG. 2*a*, the low side of the G33 grid 50 includes an elongated common aperture 50*a* through which the three electron beams are directed in a spaced manner. Disposed along the length of the common aperture 50*a* are three enlarged portions formed by paired circular arcs in the upper and lower edges of the common aperture. Each of the spaced enlarged portions in the common aperture 50*a* is provided with a diameter of d4. Similarly, as shown in FIG. 2*d* for the high side of the G31 grid 46, this grid includes an elongated common aperture 46*a* having three spaced enlarged portions through each of which a respective one of the electron beams is directed. Each of the enlarged portions of the common elongated aperture 46*a* has a diameter d1. As shown in FIG. 2*b*, the high side of the G32 grid 48 is provided with three spaced beam passing apertures each having an enlarged and generally circular inner portion with a diameter d3. Similarly, FIG. 2*c* shows the low side of the G32 grid 48 as also including three spaced beam passing apertures, each of which has an inner circular portion with a diameter d2. In accordance with the progressively reduced electron beam passing aperture size in proceeding toward the cathode(s) of the inventive electron gun 40, d4>d3>d2>d1.

Figure 3:
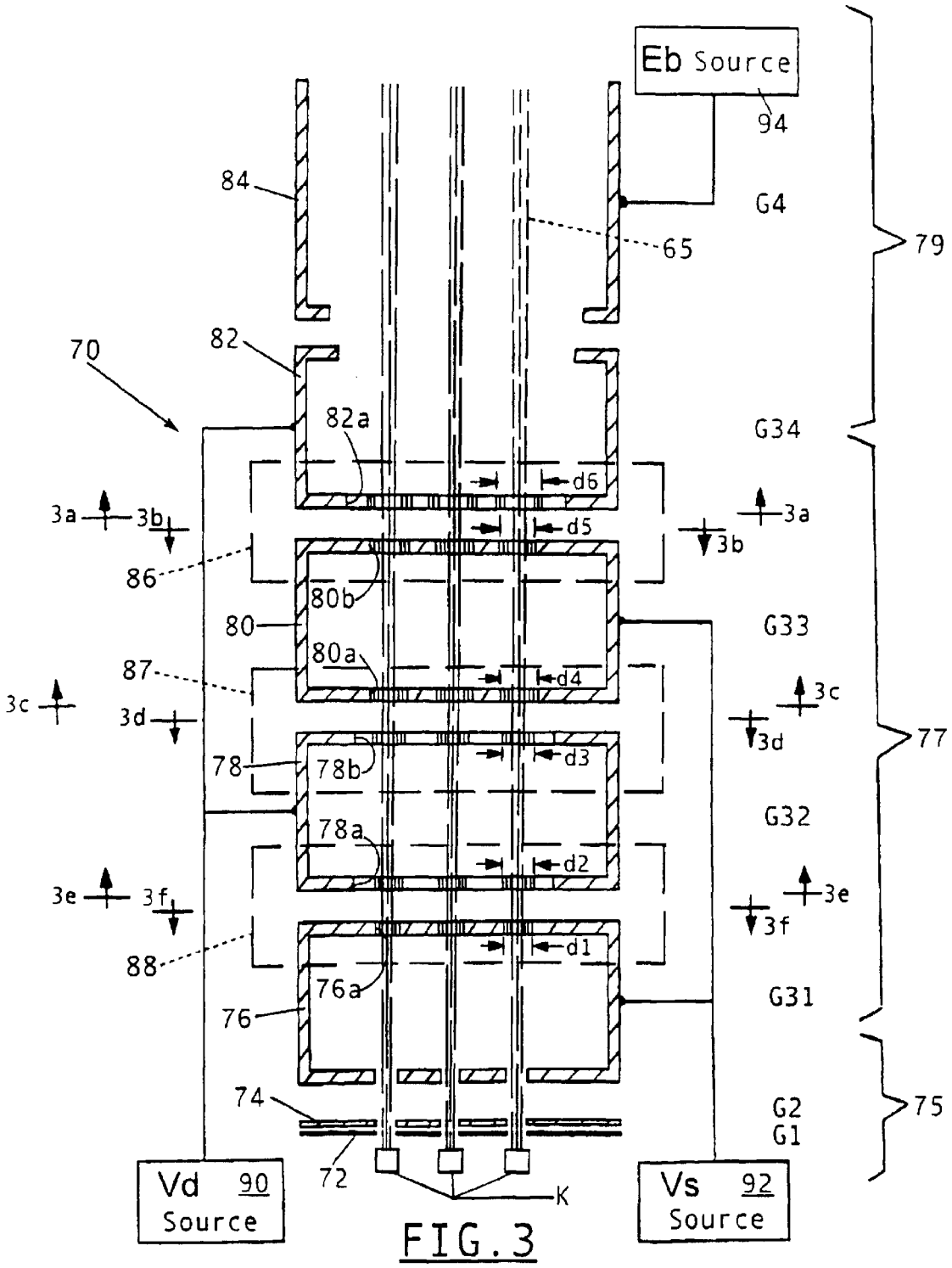
FIG. 3 is a simplified longitudinal sectional view of another embodiment of a bi-potential electron gun with progressively reduced electron beam passing aperture size in accordance with the present invention.

Referring to FIG. 3, there is shown a longitudinal sectional view of another embodiment of a bi-potential electron gun 70 in accordance with the present invention. Bi-potential electron gun 70 includes a G1 control grid 72, a G2 screen grid 74, and a G31 grid 76. The G1 control grid 72, G2 screen grid 74, and the bottom portion of the G31 grid 76 form the electron gun's BFR 75. Electron gun 70 further includes a G32 grid 78, a G33 grid 80, a G34 grid 82, and a G4 grid 84. The upper portion of the G31 grid 76, the G32 grid 78, the G33 grid 80, and the lower portion of the G34 grid 82 form the electron gun's dynamic focus lens 77. The top portion of the G34 grid 82 and the G4 grid 84 form the electron gun's main focus lens 79. The electron gun's cathode K directs energetic electrons through aligned apertures in the aforementioned grids, with the electron gun's BFR 75 forming the electrons into an electron beam 65 (shown in the figure in dotted line form). As shown in FIG. 3, the diameter of the electron beam 65 expands as previously described as it transits aligned apertures in the various grids in traveling from the electron gun's cathode K to its display screen (which is not shown in the figure for simplicity).

A variable voltage $V_d$ source 90 is connected to and charges the electron gun's G32 grid 78 and G34 grid 82. A voltage applied to the G32 grid 78 and G34 grid 82 by the variable voltage $V_d$ source 90 varies as the electron beams are swept across the CRT's display screen. A fixed voltage $V_s$ source 92 is coupled to and charges the G31 grid 76 and G33 grid 80. An anode voltage $E_b$ source 94 is connected to and charges the G4 grid 84 for focusing and accelerating the electron beams toward the CRT's display screen. The time variable voltage applied to the G34 grid 82 and the G32 grid 78 in combination with the fixed voltage applied to the G33 grid 80 and the G31 grid 76 and the relative positions of these grids results in the formation of three dynamic quadrupoles in the electron gun's dynamic focus lens 77. Thus, a first dynamic quadrupole 86 (shown in dotted line form) is formed between the bottom portion of the G34 grid 82 and the top portion of the G33 grid 80. A second dynamic quadrupole 87 (also shown in the figure in dotted line form) is formed between the bottom portion of the G33 grid 80 and the top portion of the G32 grid 78. Finally, a third dynamic quadrupole 88 (also shown in dotted line form) is formed between the bottom portion of the G32 grid 78 and the top portion of the G31 grid 76. The combination of the first, second and third dynamic quadrupoles 86, 87 and 88 form the dynamic quadrupole lens region to compensate for the astigmatism effect of the CRT's deflection yoke.

As shown in FIG. 3, the beam passing aperture 76*a* in the top portion of the G31 grid 76 has a diameter d1. The apertures 78*a* and 78*b* respectively in the bottom and top portions of the G32 grid 78 are provided with respective diameters of d2 and d3. The apertures 80*a* and 80*b* respectively in the bottom and top portions of the G33 grid 80 are provided with respective diameters of d4 and d5. Finally, the aperture 82*a* in the bottom portion of the G34 grid 82 is provided with a diameter of d6. In accordance with the embodiment of the invention shown in FIG. 3, d6>d5>d4>d3>d2>d1. By progressively reducing the diameters of the electron beam passing apertures in the charged grids in the electron gun's dynamic focus lens 77, as the diameter of the electron beam 65 is reduced in proceeding toward cathode K, the focusing sensitivity of the electron gun's dynamic focus lens on the electron beams is substantially increased. By increasing electron beam focusing sensitivity, the dynamic focusing voltage in the electron gun's dynamic focus lens 77 may be reduced resulting in a corresponding reduction in dynamic spherical aberration in the election beam spot on the CRT's display screen.

Figure 3A:
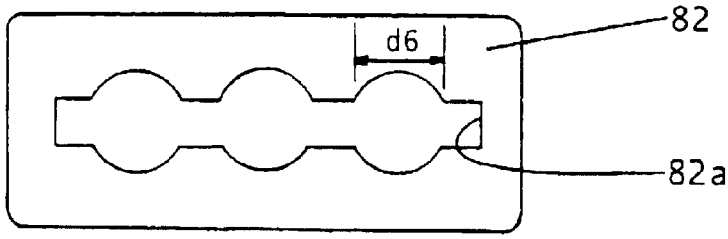
FIGS. 3*a*–3*f* are sectional views of the bi-potential electron gun shown in FIG. 3 taken respectively along sight lines 3*a*—3*a*, 3*b*—3*b*, 3*c*—3*c*, 3*d*—3*d*, 3*e*—3*e* and 3*f*—3*f* therein.
Figure 3B:
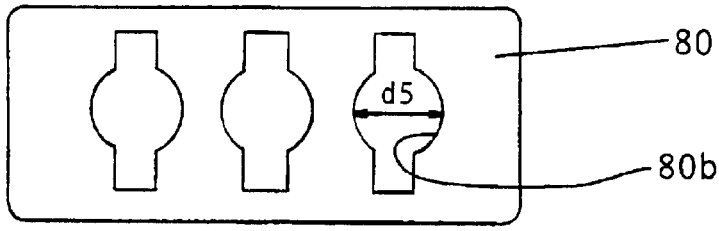
Figure 3C:
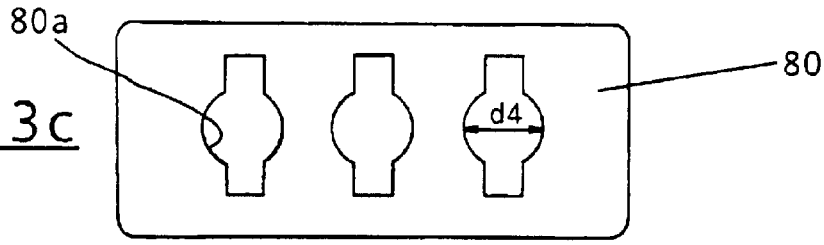
Figure 3D:
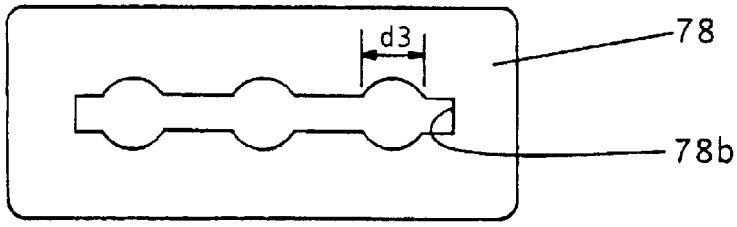
Figure 3E:
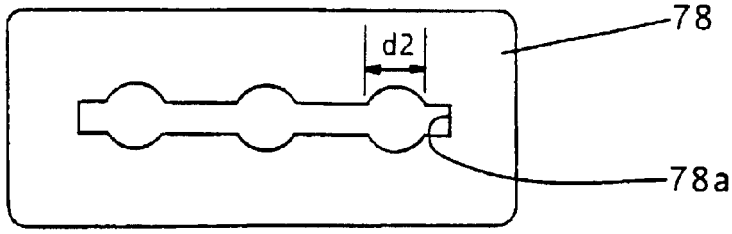
Figure 3F:
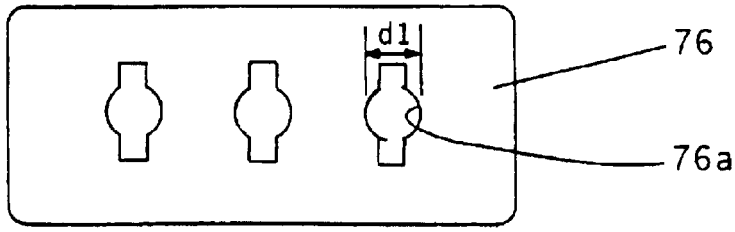

Referring to FIGS. 3*a*–3*f*, there are shown sectional views of the bi-potential electron gun 70 shown in FIG. 3 taken respectively along sight lines 3*a*—3*a*, 3*b*—3*b*, 3*c*—3*c*, 3*d*—3*d*, 3*e*—3*e* and 3*f*—3*f*. As shown in FIG. 3*a*, the low side of the G34 grid 82 is provided with an elongated common beam passing aperture 82*a* having three spaced enlarged portions disposed along its length. Each of the enlarged portions in the common beam passing aperture 82 is generally circular and has a diameter d6. As shown in FIG. 3*d*, the high side of the G32 grid 78 is also provided with an elongated common beam passing aperture through which all three electron beams are directed. The common beam passing aperture 78*b* is also provided with three spaced enlarged portions along its length, each having a generally circular shape. The spaced enlarged portions of the common beam passing aperture 78*b* are each provided with a diameter d3. Similarly, the low side of the G32 grid 78 is provided with an elongated common beam passing aperture 78*a* having three spaced enlarged portions disposed along the length thereof. Each of the enlarged portions of the common beam passing aperture 78*a* has a diameter d2. FIG. 3*b* is an elevation view of the high side of the G33 grid 80 which includes three spaced beam passing apertures through each of which is directed a respective one of the electron beams. The three spaced apertures in the high side of the G33 grid 80 are each provided with an enlarged, generally circular inner portion having a diameter d5. As shown in FIG. 3*c*, the low side of the G33 grid 80 is also provided with three spaced beam passing apertures each having an inner enlarged portion with a diameter d4. Similarly, as shown in FIG. 3*f*, the high side of the G31 grid 76 is provided with three spaced beam passing apertures each having an enlarged, generally circular inner portion having a diameter d1. As shown in FIGS. 3*a*–3*f*, the enlarged, generally circular portions of the beam passing apertures of the G34 grid 82, the G33 grid 80, the G32 grid 78, and the G31 grid 76 are defined by the relationship d6>d5>d4>d3>d2>d1.

Figure 4:
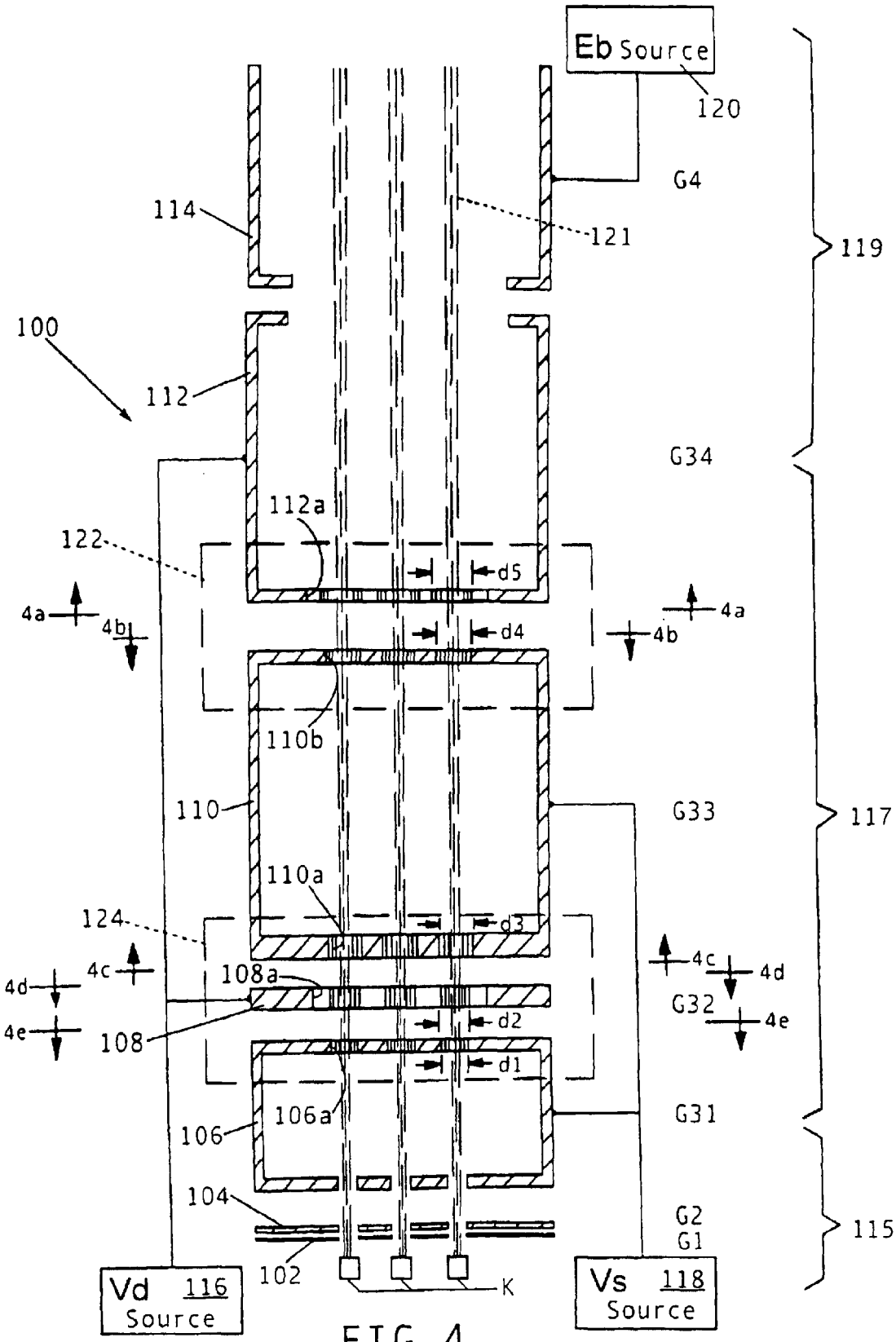
FIG. 4 is a simplified longitudinal sectional view of yet another embodiment of a bi-potential electron gun with progressively reduced electron beam passing aperture size in accordance with the present invention.

Referring to FIG. 4, there is shown a longitudinal sectional view of another embodiment of a bi-potential electron gun 100 in accordance with the present invention. Electron gun 100 includes one or more cathodes K which direct one or more electron beams 121 through aligned apertures in a G1 control grid 102, a G2 screen grid 104, and a G31 grid 106. The combination of the G1 control grid 102, G2 screen grid 104, and the bottom portion of the G31 grid 106 forms the electron gun's BFR 115. Electron gun 100 further includes a G32 grid 108, a G33 grid 110, a G34 grid 112, and a G4 grid 114. The top portion of the G31 grid 106, the G32 grid 108, the G33 grid 110, and the bottom portion of the G34 grid 112 form the electron gun's dynamic focus lens 117. The top portion of the G34 grid 112 and the G4 grid 114 form the electron gun's main focus lens 119. Each of the aforementioned grids includes at least one aperture, where all of the apertures are arranged in linear alignment for passing electron beam 121 which is incident upon the display screen (not shown for simplicity) of a CRT for displaying a video image. In the case of a monochrome CRT, all of the beam passing apertures are arranged along a single linear axis, while in the case of a color CRT three such arrays of linearly aligned apertures are provided for, with each aligned array of apertures passing a respective electron beam for providing one of the primary colors of red, green and blue.

A dynamic voltage $V_d$ source 116 is coupled to and charges the G34 grid 112 and the G32 grid 108. A fixed voltage $V_s$ source 118 is coupled to and charges the G33 grid 110 and the G31 grid 106. An anode voltage $E_b$ source 120 is coupled to and charges the G4 grid 114 for focusing and accelerating the electron beam(s).

A first dynamic quadrupole 122 (shown in dotted line form) is formed by the bottom portion of the G34 grid 112 and the top portion of the G33 grid 110. A second dynamic quadrupole 124 (also shown in dotted line form) is formed by the bottom portion of the G33 grid 110, the G32 grid 108, and the top portion of the G31 grid 106. The combination of the first and second dynamic quadrupoles 122 and 124 forms a quadrupole lens which compensates for the astigmatism effect on the electron beam 121 caused by the CRT's deflection yoke. The first dynamic quadrupole 122 is comprised of two elements, while the second dynamic quadrupole 124 is comprised of three elements.

In the first dynamic quadrupole 122, an electron beam passing aperture 112*a* in the bottom portion of the G34 grid 112 is provided with a diameter of d5. Also in the first quadrupole 122, an electron beam passing aperture 110*b* in the top portion of the G33 grid 110 is provided with a diameter of d4. In the second dynamic quadrupole 124, a beam passing aperture 110*a* in the bottom portion of the G33 grid 110 is provided with a diameter d3 and a beam passing aperture 108*a* in the G32 grid 108 is provided with a diameter of a d2. Also in the second dynamic quadrupole 124, a beam passing aperture 106*a* in the top portion of the G31 grid 106 is provided with a diameter d1. In accordance with the embodiment of the invention shown in FIG. 4, d5>d4>d3>d2>d1. Thus, the aligned beam passing apertures in the electron gun's dynamic focus lens 117 are of reduced diameter in proceeding from the CRT's display screen to its cathode K, corresponding to the reduced diameter of the electron beam 121 in proceeding toward cathode K. This arrangement provides increased beam focusing sensitivity in the dynamic focus lens portion of electron gun 100, while permitting a reduction in magnitude of the beam dynamic focus voltages applied to the various charged grids in the electron gun's dynamic focus lens 117 without increasing electron beam spot aberration on the CRT's display screen.

Figure 4A:
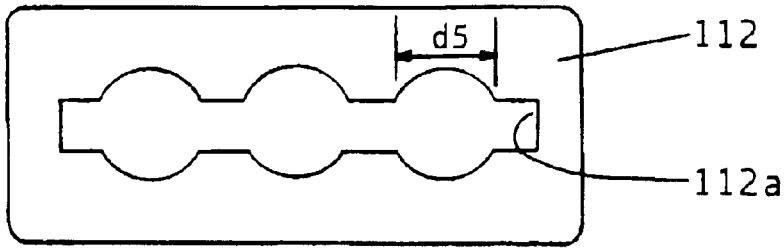
FIGS. 4*a*–4*e* are sectional views of the bi-potential electron gun shown in FIG. 4 taken respectively along sight lines 4*a*—4*a*, 4*b*—4*b*, 4*c*—4*c*, 4*d*—4*d* and 4*e*—4*e* therein.
Figure 4B:
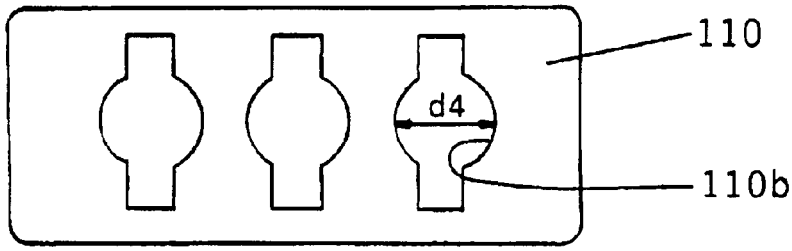
Figure 4C:
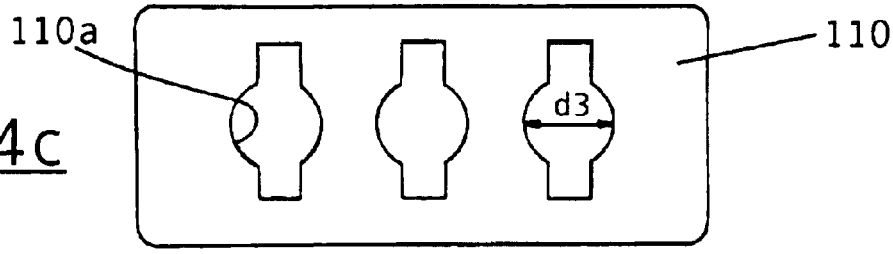
Figure 4D:
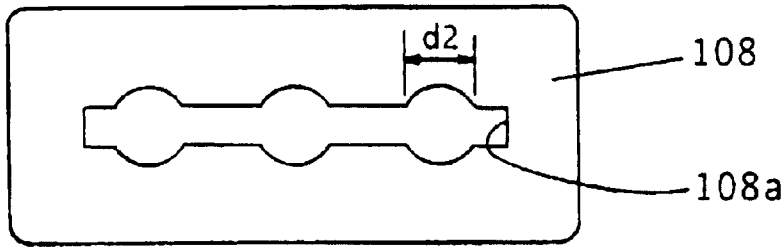
Figure 4E:
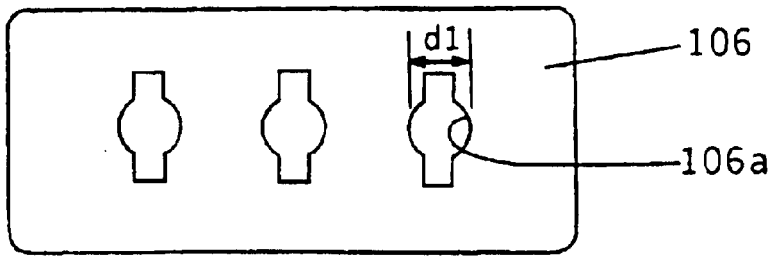

Referring to FIGS. 4*a*–4*e*, there are respectively shown sectional views of the bi-potential electron gun 100 shown in FIG. 4 taken respectively along sight lines 4*a*—4*a*, 4*b*—4*b*, 4*c*—4*c*, 4*d*—4*d* and 4*e*—4*e*. As shown in FIG. 4*a*, the low side of the G34 grid 112 is provided with an elongated, common beam passing aperture through which the three electron beams are directed. The elongated, common beam passing aperture 112*a* includes three spaced, generally circular enlarged portions each having a diameter d5. As shown in FIG. 4*d*, the G32 grid 108 also includes an elongated, common beam passing aperture 108*a* having three spaced, generally circular enlarged portions through each of which is directed a respective electron beam. The enlarged portions disposed in a spaced manner along the common beam passing aperture 108*a* each have a diameter d2. As shown in FIG. 4*b*, the high side of the G33 grid 110 includes three spaced beam passing apertures each having a generally circular inner portion with a diameter d4. As shown in FIG. 4*c*, the low side of the G33 grid 110 similarly includes three spaced beam passing apertures each having an inner enlarged, generally circular portion through which a respective electron beam is directed. Each of the enlarged portions of the beam passing apertures in the G33 grid has a diameter d3. Similarly, as shown in FIG. 4*e*, the high side of the G31 grid 106 includes three spaced beam passing apertures, each having an enlarged, generally circular inner portion through which a respective electron beam is directed. The enlarged, generally circular inner portion of each of the beam passing apertures in the G31 grid 106 has a diameter d1. In accordance with the progressively reduced electron beam passing aperture size in proceeding toward the electron gun's cathode arrangement of the present invention, d5>d4>d3>d2>d1.

Figure 5:
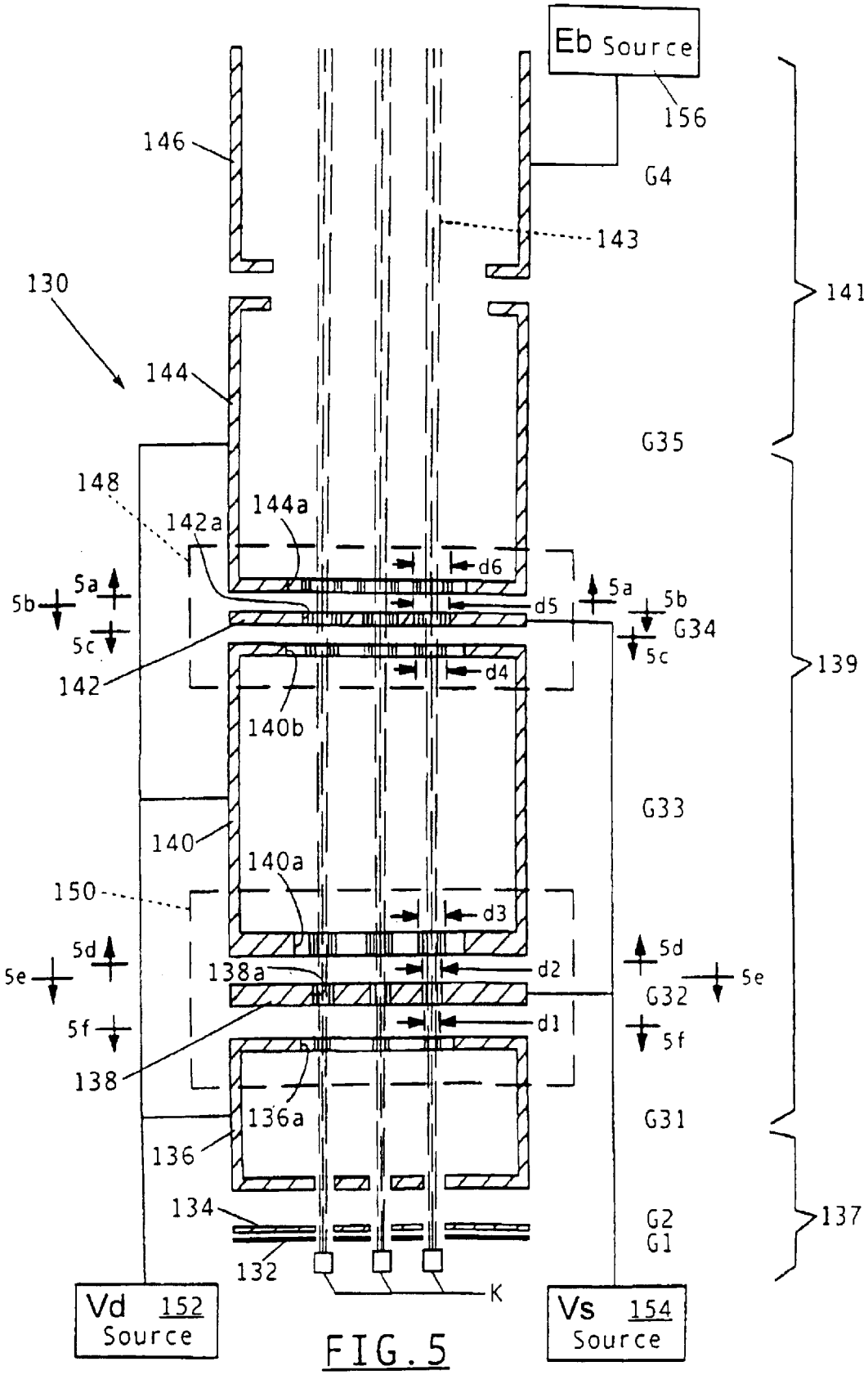
FIG. 5 is a simplified longitudinal sectional view of still another embodiment of a bi-potential electron gun with progressively reduced electron beam passing aperture size in accordance with the present invention.

Referring to FIG. 5, there is shown a longitudinal sectional of another embodiment of a bi-potential electron gun 130 incorporating progressively reduced electron beam passing aperture size in accordance with the present invention. The bi-potential electron gun 130 includes a cathode K (or cathodes in case of a color CRT) which directs energetic electrons through aligned apertures in a G1 control grid 132, a G2 screen grid 134, and a G31 grid 136. The G1 control grid 132, G2 screen grid 134 and the bottom portion of the G31 grid 136 form the BFR 137 of electron gun 130. The electron gun 130 further includes a G32 grid 138, a G33 grid 140, a G34 grid 142, a G35 grid 144, and a G4 grid 146. Each of the aforementioned grids has one or more apertures in common alignment for passing an electron beam 143 (shown in the figure in dotted line form) which is incident upon the display screen (not shown in the figure for simplicity) of the CRT.

A time variable voltage $V_d$ source 152 is coupled to and charges the electron gun's G31 grid 136, G33 grid 140, and G35 grid 144. A fixed voltage $V_s$ source 154 is coupled to and charges the electron gun's G32 grid 138 and G34 grid 142. An anode voltage $E_b$ source 156 is coupled to and charges the B34 grid 146 for focusing and accelerating the electron beam 143 toward the CRT's display screen.

The top portion of the G31 grid 136 in combination with the G32 grid 138, the G33 grid 140, the G34 grid 142, and the bottom portion of the G35 grid 144 form the electron gun's dynamic focus lens 139. The top portion of the G35 grid 144 and the G4 grid 146 form the electron gun's main focus lens 141.

The bottom portion of the G35 grid 144 in combination with the G34 grid 142 and the top portion of the G33 grid 140 form a first dynamic quadrupole 148 (shown in the figure in dotted line form). Similarly, the bottom portion of the G33 grid 140 in combination with the G32 grid 138 and the top portion of the G31 grid 136 form a second dynamic quadrupole 150 (also shown in dotted line form). The time variable voltage provided by the $V_d$ source 152 to the G31 grid 136, the G33 grid 140, and the G35 grid 144 permits the first and second dynamic quadrupoles 148 and 150 to focus the electron beam 143 (or beams) on the CRT's display screen as the beams are swept across the display screen in forming a video image thereon. The first and second dynamic quadrupoles 148, 150 correct for astigmatism in the electron beam's spot on the display screen as the electron beam (or beams) are deflected over the display screen caused by the CRT's inline magnetic deflection yoke. The first and second dynamic quadrupoles 148, 150 also correct for out-of-focus effects on the electron beam arising from changes in the electron beam's landing distance as it is incident upon the display screen.

As shown in FIG. 5, the beam passing apertures in the electron gun's dynamic focus lens 139 are of decreasing diameter in proceeding toward cathode K. Thus, the beam passing aperture 144*a* in the bottom portion of the G35 grid 144 has a diameter d6, while the beam passing aperture 142*a* in the G34 grid 142 has a diameter of d5. Similarly, the top portion of the G33 grid 144 is provided with a first beam passing aperture 140*b* having a diameter d4, while the bottom portion of this grid is provided with a second beam passing aperture 140*a* having a diameter d3. Finally, the G32 grid 138 includes a beam passing aperture 138*a* having a diameter d2, while the top portion of the G31 grid 136 is provided with a beam-passing aperture 136*a* having a diameter d1. In accordance with this embodiment of the present invention, d6>d5>d4>d3>d2>d1. By reducing the diameter of the beam passing aperture in the electron gun's dynamic focus lens 139 in proceeding towards it's cathode K, the focusing sensitivity of the dynamic focus lens on the electron beam 143 is substantially increased and compensates for the reduced diameter of the electron beam in proceeding toward cathode K. By increasing the focusing sensitivity of the electron gun's dynamic focus lens 139 on the electron beam 143, the peak dynamic voltage applied by the $V_d$ source 152 to the G31 grid 136, the G33 grid 140, and the G35 grid 144 may be substantially reduced, resulting in a corresponding reduction in the dynamic spherical aberration of the electron beam's spot on the CRT's display screen.

Figure 5A:
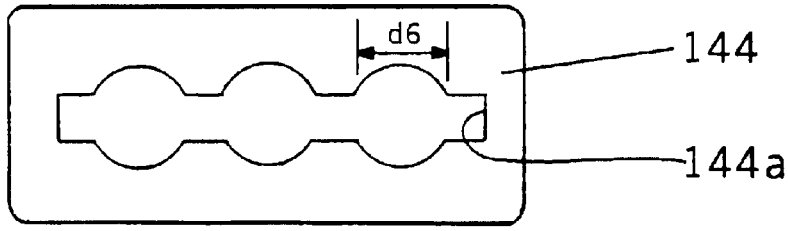
FIGS. 5*a*–5*f* are sectional views of the bi-potential electron gun shown in FIG. 5 taken respectively along sight lines 5*a*—5*a*, 5*b*—5*b*, 5*c*—5*c*, 5*d*—5*d*, 5*e*—5*e* and 5*f*—5*f* therein.
Figure 5B:
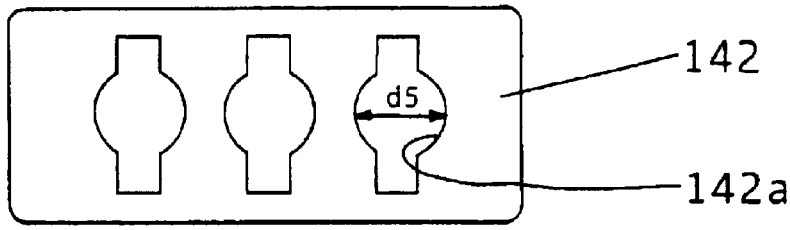
Figure 5C:
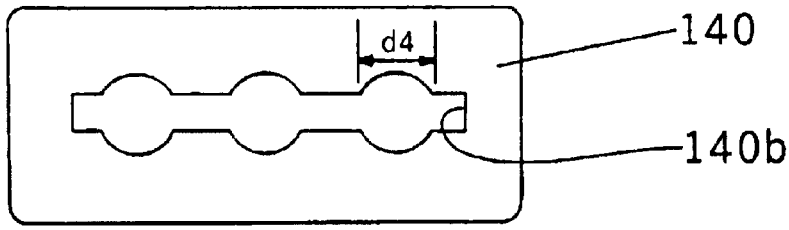
Figure 5D:
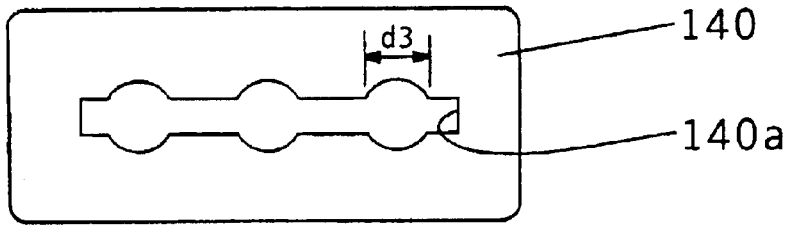
Figure 5E:
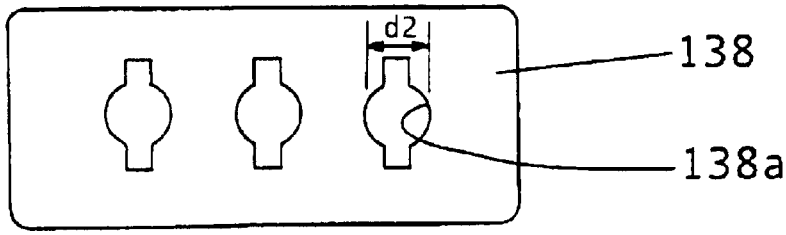
Figure 5F:
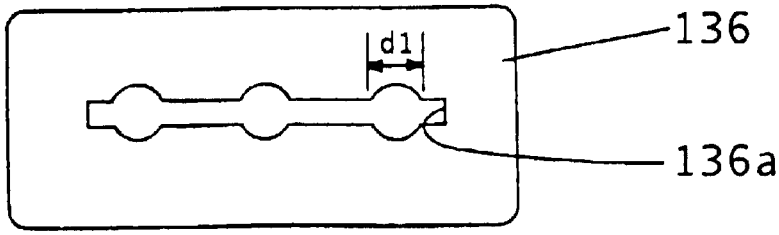

Referring to FIGS. 5*a*–5*f*, there are respectively shown sectional views of the bi-potential electron gun 130 shown in FIG. 5 taken along sight lines 5*a*—5*a*, 5*b*—5*b*, 5*c*—5*c*, 5*d*—5*d*, 5*e*—5*e* and 5*f*—5*f* therein. As shown in FIG. 5*a*, the low side of the G35 grid 144 includes an elongated, common electron beam passing aperture 144*a* having three spaced enlarged portions arranged along its length. Each of the enlarged portions in the common beam passing aperture 144*a* is generally circular and has a diameter d6. As shown respectively in FIGS. 5*c* and 5*d*, the high and low sides of the G33 grid 140 each include a respective elongated, common electron beam passing aperture 140*b* and 140*a*. Each of the elongated common beam passing apertures 144*b*, 144*a* includes three spaced, enlarged portions each having a diameter of d4 and d3, respectively. Similarly, as shown in FIG. 5*f*, the high side of the G31 grid 136 includes an elongated, common beam passing aperture having three spaced enlarged portions disposed along its length. Each of the spaced enlarged portions in the common beam passing aperture 136*a* is generally circular and has a diameter d1. As shown in FIG. 5*b*, the G34 grid 142 includes three spaced electron beam passing apertures through each of which a respective electron beam is directed. Each of the beam passing apertures in the G34 grid 142 has an inner, enlarged, generally circular portion having a diameter d5. Similarly, as shown in FIG. 5*e*, the G32 grid 138 includes three spaced electron beam passing apertures through each of which a respective electron beam is directed. Each of the three electron beam passing apertures in the G32 grid 138 has an inner, enlarged, generally circular portion having a diameter d2. In accordance with the progressively reduced electron beam passing aperture size arrangement of the present invention, the aligned beam passing apertures in the grids shown in FIGS. 5*a*–5*f* have the relationship d6>d5>d4>d3>d2>d1.

Figure 6:
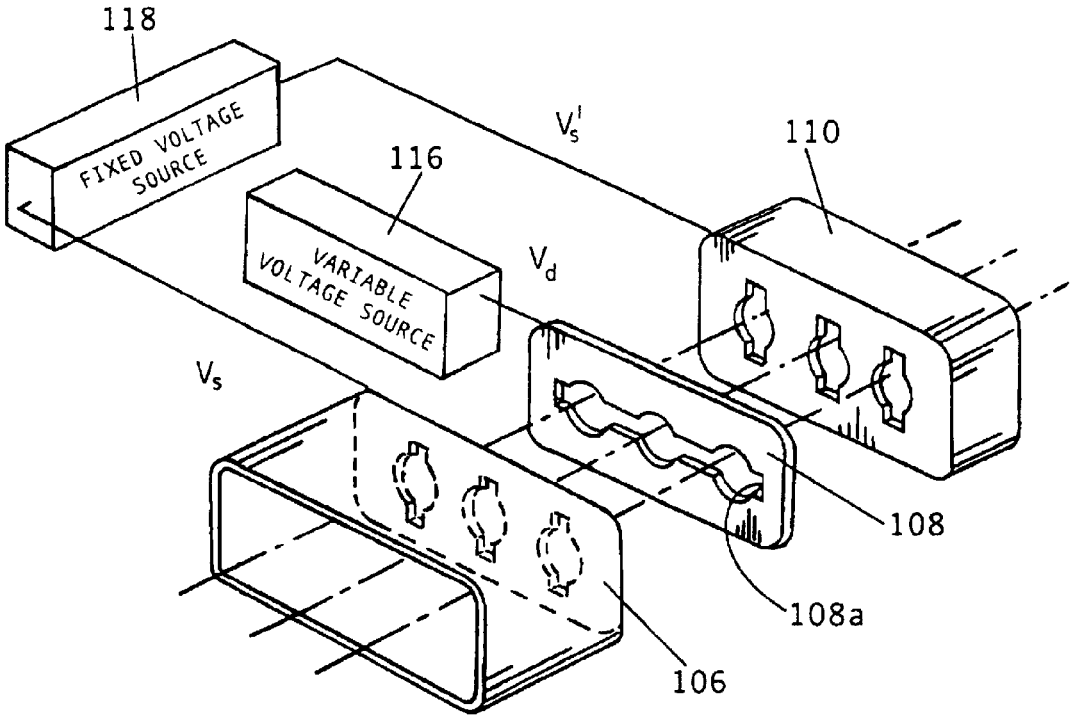
FIG. 6 is a perspective view of a portion of the bi-potential electron gun shown in FIG. 4 illustrating details of the G31 grid, the G32 grid, and the G33 grid.

Referring to FIG. 6, there is shown a simplified partial respective view of the bi-potential electron gun 100 shown in FIG. 4. As described above, the bi-potential electron gun 110 includes the G31 grid 106, the generally flat G32 grid 108, and the G33 grid 110. As described above, the high side of the G31 grid 106 includes three spaced, keyhole-shaped beam passing apertures each having an enlarged, generally circular inner portion. The low side of the G33 grid 110 similarly includes three spaced beam passing apertures also having inner, generally circular portions through which a respective electron beam is directed. Each of the three electron beams in the G33 grid 110 is larger, particularly in its inner, generally circular portion, than the corresponding beam passing aperture in the high side of the G31 grid 106 with which it is aligned. Also as described above, the G32 grid 108 includes an elongated, common electron beam passing aperture 108 through which all three electron beams are directed. Arranged in a spaced manner along the length of the common beam passing aperture 108 are three, generally circular enlarged portions through which a respective one of the electron beams is directed. The generally circular inner portion of each of the beam passing apertures in the low side of the G33 grid 110 is larger than the spaced, corresponding, aligned generally circular portions in the common beam passing aperture 108*a* of the G32 grid 108. A first fixed voltage $V_s$ is provided to the G31 grid 106 by a fixed voltage source 118. A second fixed voltage $V_s'$ is provided to the G33 grid 110 by means of the fixed voltage source 118. A dynamic voltage $V_d$ is provided to the G32 grid 108 by a variable voltage source 116.

While particular embodiments of the present invention have been shown and described, it will be obvious to those skilled in the relevant art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An electron gun for use in a cathode ray tube (CRT) having plural electron beams for producing a color video image on a display screen, said electron gun comprising:

a cathode for providing energetic electrons;

a beam forming region (BFR) aligned with said cathode and disposed intermediate said cathode and the display screen for receiving and forming said energetic electrons into a narrow beam, said BFR including plural spaced first charged grids each having one or more first aligned apertures, wherein said electrons are directed through said first aligned apertures and said electron beam increases in cross section in proceeding from said BFR toward the display screen; and an electrostatic lens disposed intermediate said BFR and the display screen and including plural spaced second grids charged by a respective focus voltage, each of said second grids having one or more second aligned apertures through which said electron beam is directed for focusing said electron beam on the display screen, wherein said second aligned apertures decrease in size in proceeding in a direction from the display screen toward said BFR for increasing focusing sensitivity of said electrostatic lens on the electron beam while decreasing said focus voltages, said electrostatic lens including a dynamic quadrupole and said second grids including a third grid having a fixed focus voltage and fourth grid having a dynamic focus voltage, said third grid including plural spaced apertures for passing a respective electron beam and said fourth grid including a single common aperture for passing said plural electron beams, said single common aperture having plural spaced enlarged portions each aligned with a respective aperture in said third grid and adapted for passing a respective electron beam, and wherein each enlarged portion is larger than an aligned beam passing aperture in said third grid, and wherein said fourth grid is disposed intermediate said third grid and the display screen.

2. An electron gun for use in a cathode ray tube (CRT) including plural electron beams for producing a color video image on a display screen, said electron gun comprising:

a cathode for providing energetic electrons;

a beam forming region (BFR) aligned with said cathode and disposed intermediate said cathode and the display screen for receiving and forming said energetic electrons into a narrow beam, said BFR including plural spaced first charged grids each having one or more first aligned apertures, wherein said electrons are directed through said first aligned apertures and said electron beam increases in cross section in proceeding from said BFR toward the display screen; and an electrostatic lens disposed intermediate said BFR and the display screen and including plural spaced second grids charged by a respective focus voltage, each of said second grids having one or more second aligned apertures through which said electron beam is directed for focusing said electron beam on the display screen, wherein said second aligned apertures decrease in size in proceeding in a direction from the display screen toward said BFR for increasing focusing sensitivity of said electrostatic lens on the electron beam while decreasing said focus voltages, said electrostatic lens including a dynamic quadrupole and said second grids including a third and having a fixed focus voltage and fourth grid having a dynamic focus voltage, said third grid including plural spaced apertures for passing a respective electron beam and said fourth grid including a single common aperture for passing said plural electron beams, said single common aperture having plural spaced enlarged portions each aligned with a respective aperture in said third grid and adapted for passing a respective electron beam, and wherein each enlarged portion is smaller than an aligned beam passing aperture in said third grid, and wherein said third grid is disposed intermediate said fourth grid and the display screen.

3. An electron gun for use in a cathode ray tube (CRT) for producing a video image on a display screen, said electron gun comprising:

a cathode for providing energetic electrons;

a beam forming region (BFR) aligned with said cathode and disposed intermediate said cathode and the display screen for receiving and forming said energetic electrons into a narrow beam, said BFR including plural spaced first charged grids each having one or more first aligned apertures, wherein said electrons are directed through said first aligned apertures and said electron beam increases in cross section in proceeding from said BFR toward the display screen; and an electrostatic lens disposed intermediate said BFR and the display screen and including plural spaced second grids charged by a respective focus voltage, each of said second grids having one or more second aligned apertures through which said electron beam is directed for focusing said electron beam on the display screen, said electrostatic lens including first and second dynamic quadrupoles each having a respective third grid and a respective fourth grid, wherein each of said third grids includes plural spaced apertures for passing a respective electron beam and each of said fourth grids includes a single common aperture having plural spaced aligned portions each adapted for passing a respective electron beam, and wherein each spaced aperture in each of said third grids is larger than an aligned enlarged portion of the single common aperture in an associated fourth grid when said fourth grid is disposed intermediate said cathode and its associated third grid, and is smaller than an aligned enlarged portion of the single common aperture in an associated fourth grid when said third grid is disposed intermediate said cathode and its associated fourth grid.

4. The electron gun of claim 3 wherein the CRT is a color CRT having three cathodes for providing three groups of energetic electrons, and wherein each of said first charged grids includes three apertures each adapted to receive and form a respective group of energetic electrons into an elongated, narrow beam.

5. The electron gun of claim 4 wherein the three apertures in each of said first charged grids are arranged in an inline array.

6. The electron gun of claim 3 wherein said BFR includes a G1 control grid, a G2 screen grid, and a bottom portion of a G3 grid.

7. The electron gun of claim 6 wherein said electrostatic lens includes a top portion of said G3 grid and plural spaced aligned focus grids disposed intermediate said G3 grid and the display screen.

* * * * *

UNITED STATES PATENT AND TRADEMARK OFFICE

CERTIFICATE OF CORRECTION

PATENT NO. : 6,815,881 B2
DATED : November 9, 2004
INVENTOR(S) : Hsing-Yao Chen and Hsiang-Lin Chang It is certified that error appears in the above-identified patent and that said Letters Patent is hereby corrected as shown below:

Column 1,
Line 54, delete “Up”

Column 2,
Line 49, delete “is” after “voltage”

Column 13,
Line 13, change “third and” to -- third grid --

Signed and Sealed this

Twenty-ninth Day of March, 2005

JON W. DUDAS
*Director of the United States Patent and Trademark Office*